United States Patent [19]

Adee et al.

[11] 4,225,345

[45] Sep. 30, 1980

[54] PROCESS FOR FORMING METAL PARTS WITH LESS THAN 1 PERCENT CARBON CONTENT

[76] Inventors: James M. Adee, 4277 Layla Way, San Diego, Calif. 92154; John A. MacPherson, 185 E. L St., Chula Vista, Calif. 92011

[21] Appl. No.: 931,966

[22] Filed: Aug. 8, 1978

[51] Int. Cl.[2] ..... B22F 3/00

[52] U.S. Cl. ..... 75/211; 75/200; 264/63

[58] Field of Search ..... 75/200, 211; 264/63

[56] References Cited

U.S. PATENT DOCUMENTS

| | | | |
|---|---|---|---|
| 3,846,126 | 11/1974 | Foley et al. | 75/211 |
| 4,000,110 | 12/1976 | Saito et al. | 264/63 |
| 4,011,291 | 3/1977 | Curry | 75/211 |
| 4,158,689 | 6/1979 | Pett et al. | 264/63 |

*Primary Examiner*—Brooks H. Hunt

*Attorney, Agent, or Firm*—Brown & Martin

[57] ABSTRACT

The disclosed process forms metal parts from a mixture containing a powdered metal, a plasticizer, and at least two binders. Some of these binder materials are selectively extractable from the mixture without sintering. After the mixture is shaped into the form of the desired part and prior to sintering, the plasticizer and the extractable binders are removed. This produces a part having both sufficient green strength and a relatively low binder content. On sintering, remaining binders decompose; and the resulting part has a carbon content of less than 1.0%.

9 Claims, 1 Drawing Figure

TABLE I.

1. FORM A MIXTURE OF:

| | WEIGHT % |
|---|---|
| A) POWDERED STEEL 17-4PH-325 MESH | 85.90 |
| B) POLYSTYRENE | 6.25 |
| C) POLYETHYLENE | 0.78 |
| D) HUNT WESSON OIL | 6.25 |
| E) STEARIC ACID | 0.78 |

2. INJECTION MOLD MIXTURE OF STEP 1.

3. PLACE MOLDED PART OF STEP 2 IN BATH OF ETHYL ALCOHOL TO REMOVE PLASTICIZERS.

4. PLACE MOLDED PART OF STEP 3 IN BATH OF TRICHLOROETHANE 1,1,1 TO REMOVE POLYSTYRENE.

5. SINTER PART OF STEP 4.

TABLE I.

1. FORM A MIXTURE OF:

| | WEIGHT % |
|---|---|
| A) POWDERED STEEL 17-4PH-325 MESH | 85.90 |
| B) POLYSTYRENE | 6.25 |
| C) POLYETHYLENE | 0.78 |
| D) HUNT WESSON OIL | 6.25 |
| E) STEARIC ACID | 0.78 |

2. INJECTION MOLD MIXTURE OF STEP 1.

3. PLACE MOLDED PART OF STEP 2 IN BATH OF ETHYL ALCOHOL TO REMOVE PLASTICIZERS.

4. PLACE MOLDED PART OF STEP 3 IN BATH OF TRICHLOROETHANE 1,1,1 TO REMOVE POLYSTYRENE.

5. SINTER PART OF STEP 4.

PROCESS FOR FORMING METAL PARTS WITH LESS THAN 1 PERCENT CARBON CONTENT

BACKGROUND OF THE INVENTION

This invention relates to processes for constructing metal parts, and more particularly to processes for producing shaped metal parts having a low carbon content. In the prior art, various attempts were made to form shaped metal parts by injection molding. However, these attempted processes were found to be not suitable for making metal parts with a carbon content of less than 1.0%.

In comparison, injection molding works fine and is widely used to form ceramic parts. Basically, the first step for forming ceramic parts by an injection molding process consists of forming a mixture of a powdered ceramic, a binder material, a plasticizer, and an oil. The ceramic is used in a powdered form because then it can be easily shaped in a mold; the binder material functions as an adhesive which holds the particles of the ceramic powder together; the plasticizer functions to make the mixture more moldable; and the lubricant function to provide an easy release of the part from the mold.

After the powdered ceramic, binder material, plasticizers, and mold lubricant have been mixed to a substantially uniform consistency, the mixture is put into a mold of a predetermined shape. Various injection molding apparatus are used to fill the mold. These include for example, apparatus wherein the mixture is forced through a nozzle by a plunger into the mold. Other apparatus force the mixture into the mold through a barrel containing a screw which rotates and carries the material into the mold.

Subsequently, the green part is removed from the mold. Then the plasticizer is removed from the green molded part. Typically, a solvent which attacks the plasticizer, but does not substantially affect the binder material is utilized to accomplish this removal. This leaves the part with sufficient porosity such that when it is sintered the binder material may be driven out.

It is, of course, desirable to form metal parts by a similar process. This is because the process is carried out at temperatures which are substantially less than those required to form metal parts from molten metal. For example, temperatures of less than 300° F. are typically required. A problem however, with carrying out the above described steps with metal powder being substituted for the ceramic powder is that the resulting parts exhibit a relatively high carbon content. This occurs bacause during sintering, the binder material that is in the green part decomposes and combines with the metal powder. In comparison, ceramic materials are relatively inactive; and thus they do not combine with the binder as it decomposes.

In order to lower the carbon content of the resulting metal parts, attempts have been made to increase the relative amount of plasticizer material and/or decrease the relative amount of binder material. The problem with this approach however, is that as the ratio of plasticizer material to binder material increases, the viscosity of the mixture decreases; and to produce metal structures with less than 1% carbon content with this process, the viscosity decreases past the point where the molded part has sufficient green strength to prevent distortion prior to sintering. This problem is most severe when the desired part has a complex shape.

Accordingly, it is one object of the invention to provide an improved method for making parts.

Another object of the invention is to provide a method of making shaped metal parts having less than 1.0% carbon content by injection molding. Still another object of the invention is to provide a method of making metal parts from a mixture containing at least two substantially different binder materials, some of which can be selectively removed prior to sintering.

SUMMARY OF THE INVENTION

These and other objectives of the invention are accomplished by a process wherein a powdered metal, a plasticizer, and at least two binder materials are mixed to a substantially uniform consistency. The binder materials are chosen such that some of them are selectively extractable from any part molded from the mixture prior to sintering. Suitably, these binder materials may consist of polystyrene and polyethylene.

Subsequently, the mixture is shaped into the desired part by injection molding. After the part is removed from the mold and prior to sintering, the plasticizer and various ones of the extractable binders are removed. Suitably, the binders may be removed by solvent extraction, sublimation, or decomposition. For example, the binder polystyrene may suitably be removed by bathing the part in 1-1-1 trichloroethane.

After the plasticizer and some of the binders have been removed, the part is sintered. During this step of the process, those binders which remained in the part decompose and partially combine with the metal powder. However, since the binder content is reduced prior to sintering, the final part also has a reduced carbon content. Metal parts with less than 0.06% carbon are readily obtained.

BRIEF DESCRIPTION OF THE DRAWING

The invention itself is set forth in the appended claims. However, specific processes carried out according to the invention will best be understood by reference to the following drawing when read in conjunction with the detailed description wherein:

Table 1 is a listing of the basic steps of a preferred process for forming metal parts of less than 1.0% carbon content according to the invention.

DETAILED DESCRIPTION

Referring now to Table 1, a specific preferred process that utilizes selective removal of binders by solvent extraction to construct metal parts having a low carbon content will be described. This process utilizes a mixture of powdered steel and two binder materials. More specifically, 85.9% of the mixture by weight is the powdered steel 17−4pH−325 mesh; 6.25% of the mixture by weight is the binder polystyrene; and 0.78% of the mixture by weight is the binder polyethylene. Also included in the mixture is Hunt Wesson Oil 101 as a plasticizer; and stearic acid as a mold lubricant.

The above materials are mixed to a uniform consistency at 300° F. in a high shear mixer. Subsequently, the mixture is pelletized, then it is shaped by injection molding. To illustrate the steps of the disclosed process, standard tensile bars having an average weight of 3.157 grams were formed. A piston type injection molding machine was used to form these bars. The nozzle temperature and pressure were 340° F. and 4,500 psi respectively; and the barrel temperature was 300° F.

Subsequently, the tensile bars were removed from the mold and placed in a bath of ethyl alcohol to remove the plasticizer. The ethyl alcohol was at room temperature; and the bath lasted 24 hours. As a result, the average weight loss of the tensile bars was 0.154 grams; or 4.8% of the total part weight.

Removal of the plasticizer opens pores in the molded part which allows for a subsequent removal of the binder polystyrene. To remove this binder material, the molded part was placed in the bath of trichloroethane 1,1,1. This bath was also at room temperature, but lasted only 12 hours. After this step of the process, the parts showed an average weight loss of 0.293 grams per sample or 9.3% of the original part weight.

Subsequently, the parts were sintered in a hydrogen atmosphere. The temperature was 2,300° F. and the dew point was −50° F. Total sintering time was six hours; and the heating rate was 8° F. per minute. As a result, the sintered parts had a density of 7.34 grams/cm$^3$, or 96% of the theoretical wrought value of 17−4 pH. Tests of the sintered part showed that the carbon content was below 0.06%.

As an alternative to the above described process, binder materials can also be selectively removed from the green part by sublimation prior to sintering This alternative proves also for example, the above described mixture bit with the polystyrene replaced by camphor. Using the new mixture, a green part is shaped by injection molding as described above. Subsequently, the camphor is removed from the green part by subjecting it to a vacuum. This lower pressure causes the camphor to vaporize. A vacuum of 10" of mercury is suitable for this purpose.

As still another alternative, binder materials can be selectively removed by decomposition prior to sintering. This process uses for example, the above described mixture but with polystyrene replaced with beeswax. Again, a green part is shaped by injection molding. Subsequently, the beeswax is removed from the green part by subjecting it to temperatures that are high enough to cause decomposition of the wax. This occurs at temperatures of approximately 350° F.

Various preferred specific steps for carrying out a process according to the invention have now been described in detail. In addition however, many changes and modifications can be made to these specific steps without departing from the nature and spirit of the invention. Therefore is not to be limited to said details, but is defined by the appended claims.

We claim:

1. A process for forming a metal part having a carbon content of less than 1% comprised of the steps of:

forming a substantially uniform mixture comprised of a powdered metal, a plasticizer, at least one first binder which is selectively extractable from said mixture without sintering and at least one further binder which is not removable by said selective extraction, the total quantities of said binders and plasticizer being selected to form a readily moldable mixture and the quantity of binder not removable by said selective extraction being sufficient to maintain the shape of the molded mixture but less than that forming a carbon content of 1.0% after sintering;

shaping said mixture into said part;

removing said plasticizer and extractable binder from said part without sintering to form a porous part having a reduced binder content which, when decomposed by sintering, leaves said part with less than said predetermined carbon content; and heating said porous part at a temperature and in an atmosphere to decompose and remove residual binder to a carbon content less than 1% and to sinter said powdered metal into a shaped metal part.

2. A process according to claim 1 wherein said step for removing said various extractable binders is performed by solvent extraction.

3. A process according to claim 1 wherein said step for removing said extractable binder is performed by sublimation.

4. A process according to claim 1 wherein said step for removing said various extractable binders is performed by decomposition.

5. A process according to claim 2 wherein said mixture includes polyethylene and polystyrene as said binders, and wherein said part is subjected to a bath in a solvent prior to said sintering step to selectively remove said polystyrene therefrom.

6. A process according to claim 3 wherein said mixture includes polyethylene and camphor as said binders, and wherein said part is subjected to a vacuum prior to said sintering step to selectively remove said camphor therefrom.

7. A process according to claim 4 wherein said mixture includes polyethylene and beeswax as said binders, and wherein said part is subjected to heating prior to said sintering step to selectively remove said beeswax therefrom.

8. A process according to claim 2 wherein said part is subjected to a first bath in a solvent for said plasticizer selectively to remove said plasticizer but not said extractable binder, thereafter said part is subjected to a bath in a solvent for said extractable binder slectively to remove said extractable binder prior to said sintering step, and said sintering step is effected in an atmosphere of hydrogen.

9. A process according to claim 5 wherein said part is subjected to a first bath in a solvent for said plasticizer selectively to remove said plasticizer but not said polystyrene, thereafter said part is subjected to a bath in a solvent for said polystyrene selectively to remove said polystyrene prior to said sintering step and said sintering step is effected in an atmosphere of hydrogen.

* * * * *

REEXAMINATION CERTIFICATE (758th)

United States Patent [19] [11] B1 4,225,345

Adee et al. [45] Certificate Issued Sep. 15, 1987

[54] PROCESS FOR FORMING METAL PARTS WITH LESS THAN 1 PERCENT CARBON CONTENT

[75] Inventors: James M. Adee, San Diego; John A. MacPherson, Chula Vista, both of Calif.

[73] Assignee: Form Physics Corp., San Diego, Calif.

Reexamination Request:
No. 90/000,961, Feb. 18, 1986

Reexamination Certificate for:

| | |
|---|---|
| Patent No.: | **4,225,345** |
| Issued: | **Sep. 30, 1980** |
| Appl. No.: | **931,966** |
| Filed: | **Aug. 8, 1978** |

[51] Int. Cl.[4] ..... B22F 1/00

[52] U.S. Cl. ..... 419/36; 264/63; 419/58

[58] Field of Search ..... 419/36, 58; 264/63

[56] References Cited

U.S. PATENT DOCUMENTS

| | | | |
|---|---|---|---|
| 2,939,199 | 6/1960 | Strivens | 25/156 |
| 3,266,893 | 8/1966 | Duddy | 75/222 |
| 4,197,118 | 4/1980 | Wiech | 75/228 |

FOREIGN PATENT DOCUMENTS 808583 7/1957 United Kingdom .

*Primary Examiner*—Stephen J. Lechert, Jr.

[57] ABSTRACT

The disclosed process forms metal parts from a mixture containing a powdered metal, a plasticizer, and at least two binders. Some of these binder materials are selectively extractable from the mixture without sintering. After the mixture is shaped into the form of the desired part and prior to sintering, the plasticizer and the extractable binders are removed. This produces a part having both sufficient green strength and a relatively low binder content. On sintering, remaining binders decompose; and the resulting part has a carbon content of less than 1.0%.

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-9 is confirmed.

New claims 10-24 are added and determined to be patentable.

*10. A process for forming a metal part having a carbon content of less than one percent (1%) and having a desired configuration, comprised of the steps of:*

*forming a substantially uniform mixture comprised of (a) predominantly the powdered metal, (b) a plasticizer, (c)* at least a first binder selectively extractable from the mixture at ambient temperatures and *(d) a second binder not removable by such selective extraction, the first binder having a greater proportion by weight in the mixture than the second binder,*

*shaping the mixture into an article having a configuration approaching the desired configuration of the metal part,*

*removing the plasticizer and the first binder from the article at ambient temperatures, and*

*sintering the article at a temperature and for a period of time to remove the carbon in the article to a content less than one percent (1%) by weight and to form the article into the metal part with the desired configuration and with dense characteristics.*

*11. A process as set forth in claim 10 wherein*

*the article is sintered at a temperature approaching the effective melting temperature of the article.*

*12. A process as set forth in claim 10 wherein*

*the plasticizer is removed from the article at the ambient temperatures before the removal of the first binder at the ambient temperatures.*

*13. A process as set forth in claim 12 wherein*

*the powdered metal has a size in the order of three hundred and twenty five (325) mesh and the mixture has the following relative composition:*

| *Material* | *Percentage By Weight in Mixture* |
|---|---|
| *Metal* | *85.90* |
| *First Binder* | *6.25* |
| *Second Binder* | *0.78* |
| *Plasticizer* | *6.25* |
| *Lubricant* | *0.78* |

*14. A process as set forth in claim 12 wherein*

*the first binder is polystyrene and the second binder is polyethylene.*

*15. A process for forming a metal part having a carbon content of less than one percent (1%) and having a desired configuration, comprised of the steps of:*

*forming a substantially uniform mixture comprised of (a) predominantly the powdered metal, (b)* a plasticizer, *(c) a first binder and (d) a second binder, the first binder having properties of being removable from the mixture at ambient temperatures and the second binder having properties of being removed from the mixture at elevated temperatures, the first binder having a greater percentage by weight in the mixture than the second binder,*

*forming from the mixture an article having a configuration generally conforming to the desired configuration but oversize relative to the desired configuration,*

*removing the plasticizer and the first binder from the mixture at ambient temperatures, and*

*sintering the article at a temperature approaching the effective melting temperature of the article and for a period of time to obtain the removal of the second binder to a carbon content less than one percent (1%) and to obtain a densification of the article to form the metal part with the desired configuration.*

*16. A process as set forth in claim 15 wherein the amount of the first binder in the mixture by weight being considerably greater than the amount of the second binder in the mixture weight.*

*17. A process as set forth in claim 15 wherein*

*the first binder is polystyrene and the second binder is polyethylene.*

*18. A process as set forth in claim 15 wherein*

*the plasticizer is removed from the article at ambient temperatures before the removal of the first binder from the article at ambient temperatures.*

*19. A process as set forth in claim 15 wherein*

*the plasticizer and the first binder are removed from the article by solvents at ambient temperatures.*

*20. A process as set forth in claim 19 wherein*

*the first binder is polystyrene and the second binder is polyethylene.*

*21. A process for forming a part having a carbon content of less than one percent (1%) and having a desired configuration, comprised of the steps of:*

*forming a substantially uniform mixture comprised of (a) predominantly the powdered metal, (b) a plasticizer, (c) at least a first binder selectively extractable from the mixture at ambient temperatures and (d) a second binder not removable by such selective extraction, the first binder having a greater proportion by weight in the mixture than the second binder,*

*shaping the mixture into an article having a configuration approaching the desired configuration of the part but oversize relative to such desired configuration,*

*removing the plasticizer and the first binder from the binder at the ambient temperatures, and*

*sintering the article at a temperature approaching the effective melting temperature of the article and for a period of time to obtain the part with dense characteristics and with the desired configuration and with a carbon content less than one percent (1%).*

*22. A process as set forth in claim 21 wherein*

*the plasticizer and the first binder are removed from the article by at least one solvent at ambient temperatures.*

*23. A process as set forth in claim 22 wherein*

*the first binder is polystyrene and the second binder is polyethylene.*

*24. A process set forth in claim 21 wherein*

*the percentage by weight of the first binder in the mixture is considerably greater than the percentage by weight of the second binder in the mixture.*

* * * * *